US005152265A

United States Patent [19]

Hummel et al.

[11] Patent Number: 5,152,265

[45] Date of Patent: Oct. 6, 1992

[54] CONTROL DEVICE FOR TURNING OFF AN INTERNAL COMBUSTION ENGINE

[75] Inventors: Karsten Hummel, Seilstein-Schmidhausen; Karl Rapp; Hansjoerg Frey, both of Stuttgart, all of Fed. Rep. of Germany

[73] Assignee: Robert Bosch GmbH, Stuttgart, Fed. Rep. of Germany

[21] Appl. No.: 829,102

[22] Filed: Jan. 31, 1992

[30] Foreign Application Priority Data

Feb. 16, 1991 [DE] Fed. Rep. of Germany ..... 4104807

[51] Int. Cl.[5] ..... F02B 77/00

[52] U.S. Cl. ..... 123/198 DB; 137/625.43

[58] Field of Search ..... 123/198 DB, DIG. 11; 137/625.43

[56] References Cited

U.S. PATENT DOCUMENTS 4,391,241 7/1983 Dohshita et al. ..... 123/198 DB 5,026,227 12/1977 Krieger ..... 123/198 DB

FOREIGN PATENT DOCUMENTS 3934389 4/1991 Fed. Rep. of Germany .

*Primary Examiner*—Noah P. Kamen

*Attorney, Agent, or Firm*—Edwin E. Greigg; Ronald E. Greigg

[57] ABSTRACT

A control device including a reversing valve, disposed in fuel lines into which a feed pump is introduced between a fuel supply tank and a suction chamber of a fuel injection pump, by means of which valve, to turn off an internal combustion engine operated with the fuel injection pump, the line connections are variable in such a way that the suction chamber communicates with the intake side of the feed pump and the compression side of the feed pump communicates with the fuel supply tank. As its valve member, the reversing valve has a slide, which carries first and second double-seat-valve closing bodies that cooperate with corresponding valve seats. The first and second double-seat-valve closing bodies form sealing elements which are detachably buttoned onto the slide that are made of an elastically deformable material. The sealing elements are provided with elastically deformable sealing lips pointing to the valve seats, so that oppositely disposed valve seats of each seat are reliably sealed off even if there are dimensional variations from manufacturing tolerances.

4 Claims, 2 Drawing Sheets

CONTROL DEVICE FOR TURNING OFF AN INTERNAL COMBUSTION ENGINE

BACKGROUND OF THE INVENTION

The invention is based on a control device for turning off an internal combustion engine as defined hereinafter.

The parent application, P 39 34 389, of the present application proposes a control device for turning off an internal combustion engine that has a reversing valve inserted into fuel lines between a feed pump and a fuel injection pump. By means of the reversing valve, to turn off the engine, the direction of feed pump operation is reversible by changing the line connections effected in the reversing valve. To turn off the engine, the suction chamber of the fuel injection pump is made to communicate with the intake side of the feed pump, and the compression side of the feed pump is made to communicate with the fuel supply tank. The reversing valve has a valve member with a double-seat-valve closing body, which is partly elastomer-coated. However, because of the elastomer coating, the valve member is expensive to make.

OBJECT AND SUMMARY OF THE INVENTION

The control device for turning off an internal combustion engine has an advantage over the prior art that the valve member is simple to make, since the sealing element can be installed afterward on it, as a separate part.

Advantageous features of and developments of the invention are defined hereinafter. Further features makes the reversing valve less sensitive to tolerances; in other words, secure sealing of the valve seats is assured even in the event of production-dictated deviations in dimension.

The invention will be better understood and further objects and advantages thereof will become more apparent from the ensuing detailed description of a preferred embodiment taken in conjunction with the drawings.

BRIEF DESCRIPTION OF THE DRAWINGS

The drawing figures show a control device with a reversing valve in longitudinal section.

DESCRIPTION OF THE PREFERRED EMBODIMENT

Figure 1:
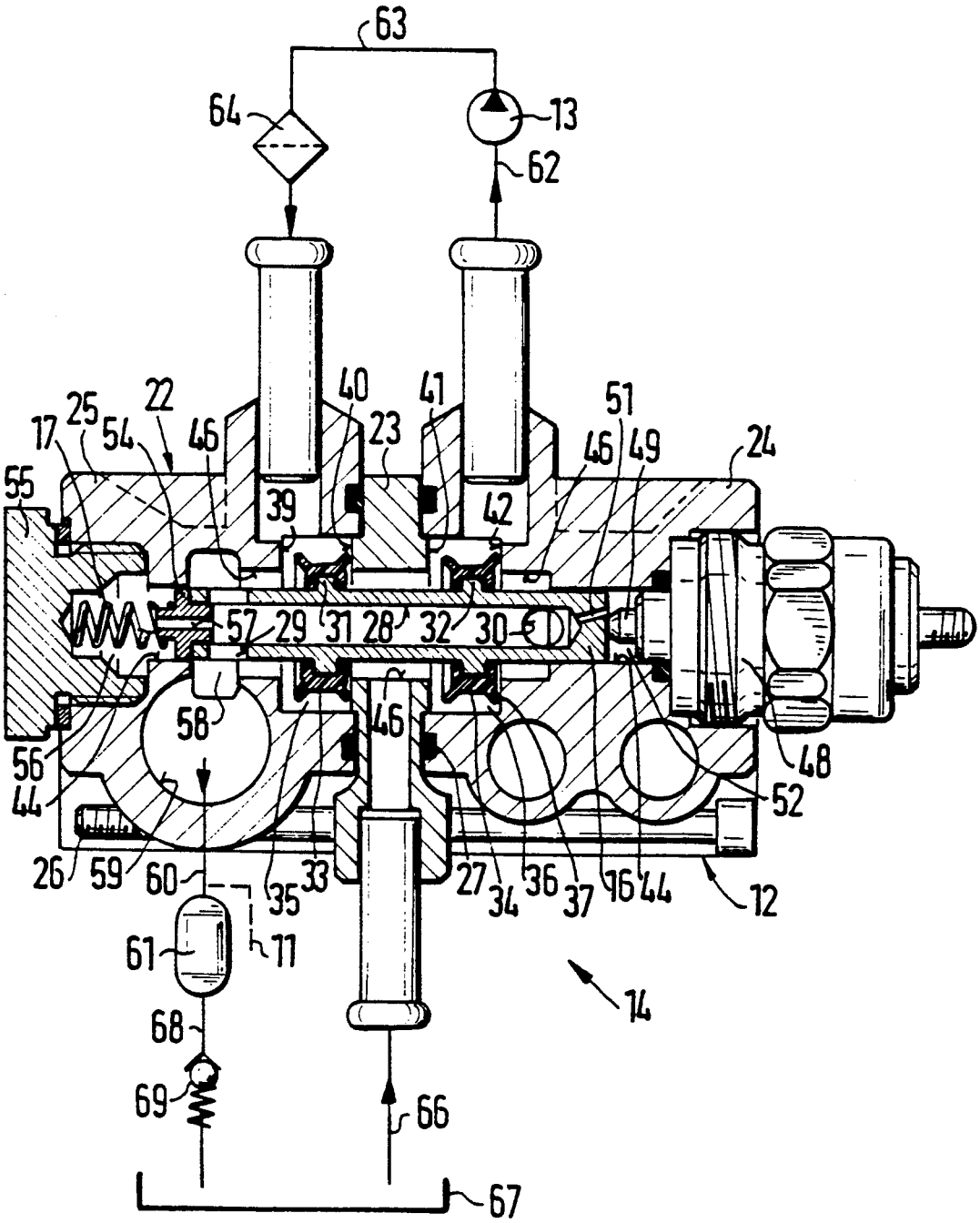
FIG. 1 shows the reversing valve in the pumping position.

A control device 14 has a reversing valve 12, introduced into the fuel circuit of a fuel injection pump 11, and a feed pump 13. The reversing valve 12 is embodied as a magnet valve, with a valve member 16 that is displaceable by the force of a restoring spring 17 into a pumping position for operating an internal combustion engine and counter to spring force into a turn-off position for turning off the engine by an electromagnet.

The reversing valve 12 is embodied as a 4/2-way valve and has a three-part housing 22, with a middle housing part 23 and two lateral housing parts 24 and 25. The housing parts 23, 24, 25 are joined to one another via a plurality of parallel screws 26 distributed about the circumference of the housing, and one sealing ring 27 is fastened between each two housing parts.

The valve member 16 of the reversing valve is embodied as a slide, which has a blind bore 28, open toward the restoring spring 17, with one transverse bore 29, 30 extending from the blind bore in each of the two end regions of the slide. The slide 16 has two radially protruding, annularly encompassing protrusions 31, 32 on its outer surface, each of which is embraced by a respective sealing element 33, 34 serving as a double-seat-valve closing body. The sealing elements 33, 34 are elastically deformable in such a way that they can be buttoned onto the protrusions 31, 32 and cannot be loosened from the protrusions by axial forces arising during operation of the reversing valve. The sealing elements 33, 34 may for instance comprise rubber or a rubber-like material. Two valve chambers 35, 36 are formed in the valve housing 22, each forming two valve seats 39 and 40, and 41 and 42, respectively. The sealing elements 33, 34 are provided with elastically deformable sealing lips 37 pointed toward the valve seats 39, 40 and 41, 42. The slide 16 may also have a plurality of axially offset radial protrusions in the region of each sealing element, so that the sealing elements can withstand even higher axial strains.

The slide is guided on both ends in bores 44 in the lateral valve housing parts 24, 25. Both the lateral valve housing parts 24, 25 and the middle valve housing part 23 also have bores 46 of larger diameter, through which the slide 16 passes with a great amount of radial play. An electromagnet 48, which acts upon the face end of the slide 16 via a pin 49, is inserted into the lateral valve housing part 24.

Via a bore 51 in the face end of the slide, the blind bore 28 communicates with the chamber 52, which is defined on one end by the slide and on the other by the electromagnet. Via a plate 54, the restoring spring 17 engages the slide 16 on the other end and keeps the slide in contact with the pin 49. The restoring spring 17 is supported on a closure part 55 that is inserted into the lateral valve housing part 25 the restoring spring 17 is disposed in a chamber 56 which communicates through a bore 57 in the plate 54 with the blind bore 28 in the slide 16. The restoring spring 17 may also engage the slide 16 directly, or in other words without any spring plate. A valve chamber 58, formed in the lateral valve housing part 25 in the region of the transverse bore 29, in the end region of the slide toward the restoring spring 17, communicates with a transverse bore 59, which communicates via a connecting line 60 with the suction chamber 61 of the fuel injection pump 11. A fuel temperature sensor may be inserted into the transverse bore 59 A suction line 62 leads from the lateral housing part 24 to the feed pump 13, from which a pressure line 63, in which a filter 64 is disposed, extends onward. The pressure line 63 discharges into the other lateral valve housing part 25. From the middle valve housing part 23, a tank line 66 leads to a fuel supply tank 67.

In the pumping position of the slide, as shown in FIG. 1, the valve seat 41 is opened, and the second sealing element 34 rests on the valve seat 42, so that the feed pump 13 can aspirate fuel from the fuel supply tank 67, via the tank line 66, through the bore 46 surrounding the slide and through the opened valve seat 41. In the pumping position of the slide 16, the first sealing element 33 closes the valve seat 40, so that the other valve seat 39 is opened. Fuel can thus be pumped by the feed pump 13 through the opened valve seat 39 and through the bore 46 surrounding the slide 16 in the lateral valve housing part 25 into the transverse bore 59, and from it via the connecting line 60 into the suction chamber 61 of the fuel injection pump 11. An overflow line 68, in which a one-way overflow valve 69 is disposed, leads away from the suction chamber 61 and discharges into the fuel supply tank 67. In the pumping position, the slide 16 is retained in contact with the pin 49 of the electromagnet 48, when it has no current, by the force of the restoring spring 17.

Figure 2:
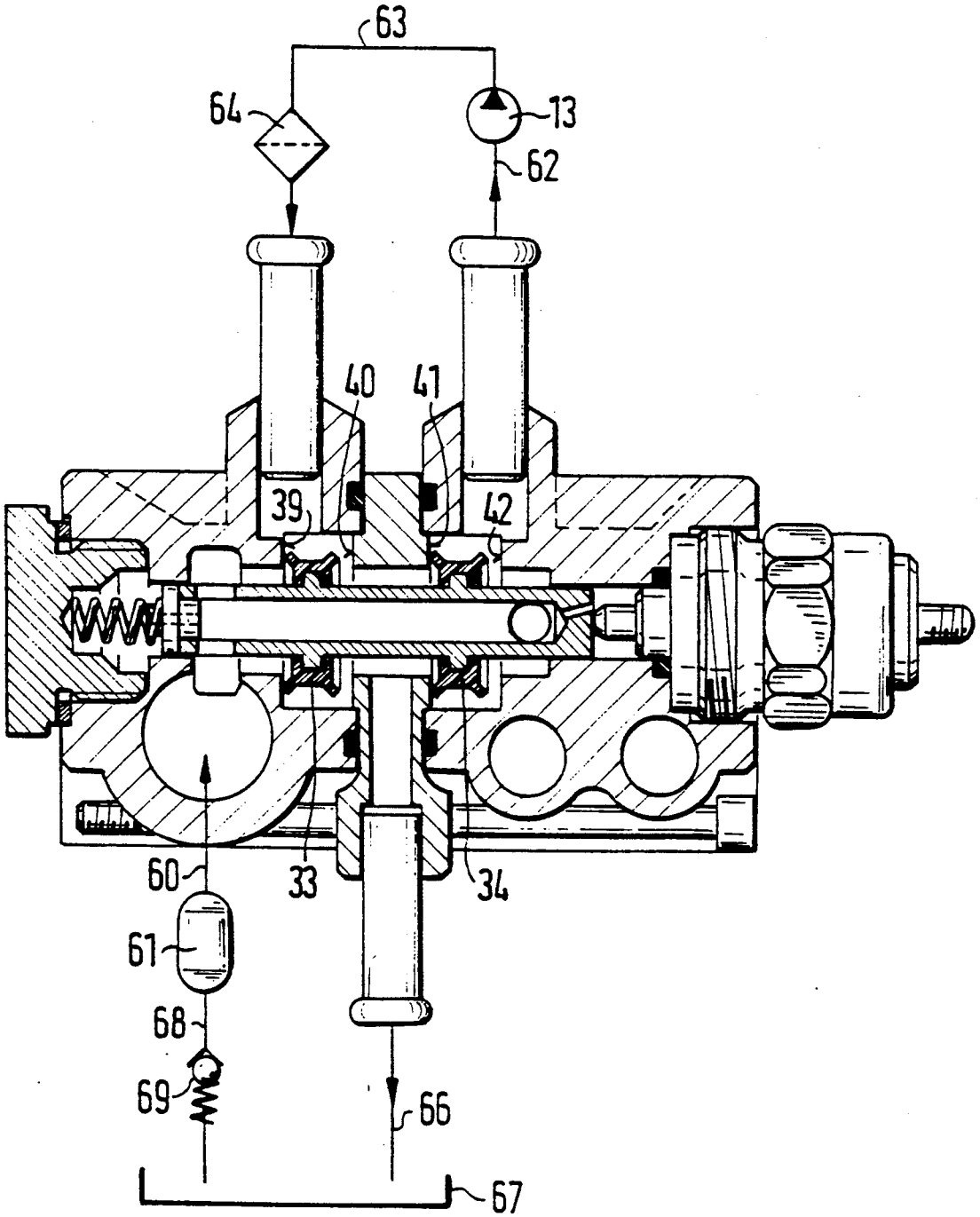
FIG. 2 shows it in the turn-off position.

In the turn-off position, shown in FIG. 2, the slide 16 is pushed by the pin 49, moved toward the restoring spring 17 when the electromagnet 48 has current, thereby compressing the restoring spring 17. In the turn-off position, the first sealing element 33 closes the valve seat 39, and the second sealing element 34 closes the valve seat 41. The suction line 62 to the feed pump 13 communicates in this position with the transverse bore 59 in the lateral valve housing part 25 and thus with the suction chamber 61 of the fuel injection pump 11, through the valve seat 42 kept open by the second sealing element 34 and through the transverse bore 30 and the blind bore 28 and the transverse bore 29 in the slide 16. At that time the pressure line 63 of the feed pump 13 communicates with the tank line 66, through the valve seat 39, kept open by the first sealing element 33, and through the bore 46 surrounding the slide 16 in the middle housing part 23. In the turn-off position, the feed pump 13 thus evacuates the suction chamber 61 of the fuel injection pump until it is empty and pumps the fuel from the suction chamber into the fuel supply tank 67. When the slide 16 is adjusted between the pumping position and the turn-off position, the sealing lips 37 first come to rest on the applicable valve seat and yield elastically, thus reliably sealing off the valve seat. The elastic deformation of the sealing lips 37 can compensate for such manufacturing inaccuracies as deviations in the spacing of the valve seats, so that nevertheless both valve seats required for the particular position are sealed off.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the U.S. is:

1. A control device for turning off an internal combustion engine, having a feed pump (13) that aspirates fuel from a fuel supply tank (67) via a tank line (66) and a suction line (62) and pumps the fuel to the inlet of a suction chamber (61) of a fuel injection pump (11) via a pressure line (63) and a connecting line (60), a reversing valve (12), embodied as a two-position multiway valve that in its pumping position connects the tank line (66) to the suction line (62) and connects the pressure line (63) to the connecting line (60), wherein the reversing valve has a valve member (16) guided axially movably in a valve housing (22) and is reversible from the pumping position for engine operation into a turn-off position for turning the engine off, in the latter position the suction chamber (61) of the fuel injection pump (11) is connected to the suction line (62) of the feed pump (13) and its pressure line (63) is connected to the tank line (66), and a one-way overflow valve (69) that limits the pressure in the suction chamber (61) inserted into an overflow line (68) that returns the fuel from the suction chamber (61) to the fuel supply tank (67), wherein the valve member (16) of the reversing valve (12), at least for controlling the communication between the tank line (66) in the suction line (62) of the feed pump (13), is provided with a first double-seat-valve closing body that cooperates with first and second opposed valve seats (41, 42) located in the valve housing (24), of which the first valve seat (41) is kept open by the first double-seat-valve closing body and the second valve seat (42) is closed in the pumping position of the reversing valve, when in the off position, the first valve seat (41) is closed and the second valve seat (42) is kept open, the first double-seat-valve closing body is embodied by a sealing element (34) of an elastic material that is buttoned detachably onto the valve member (16) and has oppositely disposed resiliently yielding sealing lips (37) pointing toward the first and second valve seats (41, 42).

2. A control device as defined by claim 1, in which the valve member (16) of the reversing valve (12) has, in addition to the first double-seat-valve closing body (34) associated with the suction line (62), a second double-seat-valve closing body (33), which likewise cooperates with third and fourth opposed valve seats (39, 40) located in the valve housing (22), of which one valve seat (39) of the further seat-valve closing body (33) keeps the communication between the pressure line (63) and the connecting line (60) open in the pumping position of the reversing valve (12) and closes it in the turn-off position, and the fourth valve seat (40) keeps the communication between the pressure line (63) and the tank line (66) open in the turn-off position of the reversing valve (12) and closes it in the pumping position, wherein the second double-seat-valve closing body is likewise formed by a sealing element (33) of an elastic material that is detachably buttoned onto the valve member (16) and has oppositely disposed resiliently yielding sealing lips (37) pointing to the valve seats (39, 40).

3. A control device as defined by claim 1, in which the valve member (16) has a blind bore (28), through which the connecting line (60) can be made to communicate with the suction line (62), in the turn-off position of the reversing valve (12).

4. A control device as defined by claim 2, in which the valve member (16) has a blind bore (28), through which the connecting line (60) can be made to communicate with the suction line (62), in the turn-off position of the reversing valve (12).

* * * * *